US006620218B2

(12) United States Patent
Mårs et al.

(10) Patent No.: US 6,620,218 B2
(45) Date of Patent: Sep. 16, 2003

(54) IRON POWDER COMPOSITIONS

(75) Inventors: Owe Mårs, Viken (SE); Björn Lindqvist, Helsingborg (SE); Åsa Ahlin, Höganäs (SE)

(73) Assignee: Höganäs AB, Höganäs (SE)

( * ) Notice: Subject to any disclaimer, the term of this patent is extended or adjusted under 35 U.S.C. 154(b) by 4 days.

(21) Appl. No.: 09/767,737

(22) Filed: Jan. 24, 2001

(65) Prior Publication Data

US 2002/0146341 A1 Oct. 10, 2002

Related U.S. Application Data

(63) Continuation of application No. PCT/SE99/01850, filed on Oct. 14, 1999.

(30) Foreign Application Priority Data

Oct. 16, 1998 (SE) ..... 9803566

(51) Int. Cl.[7] ..... B22F 1/00
(52) U.S. Cl. ..... 75/252; 75/246
(58) Field of Search ..... 75/252, 246

(56) References Cited

U.S. PATENT DOCUMENTS

| | | | | |
|---|---|---|---|---|
| 5,286,275 A | | 2/1994 | Murakami et al. | 75/252 |
| 5,368,630 A | * | 11/1994 | Luk | 75/252 |
| 5,498,276 A | | 3/1996 | Luk | 75/252 |
| 6,068,813 A | * | 5/2000 | Semel | 75/246 |

FOREIGN PATENT DOCUMENTS

| | | |
|---|---|---|
| DE | 41 01 292 | 7/1991 |
| WO | 18275 | 10/1992 |

OTHER PUBLICATIONS

Derwent Acc No. 1991–216463, Gosselin, F. for DE 4101292, Jul. 18, 1991. Abstract.*
Copy of International Search Report dated Jan. 29, 2000.

* cited by examiner

*Primary Examiner*—Roy King
*Assistant Examiner*—Andrew Wessman
(74) *Attorney, Agent, or Firm*—Burns, Doane, Swecker & Mathis, L.L.P.

(57) ABSTRACT

The invention concerns a method of improving the dynamic properties of compacted and sintered products having a density between 6.8 and 7.6 g/cm$^3$, preferably between 7.0 and 7.4 g/cm$^3$. According to this method an iron based powder, graphite and a solid particular lubricant having a vaporizing temperature less the sintering temperature, preferably less than about 800° C. is compacted and sintered and the maximum particle size of the lubricant is selected so that the largest pores of a compacted and sintered product prepared from the composition are equal to or less than the largest pores obtained in a compacted and sintered product prepared from the composition without lubricant. The invention also concerns composition of an iron based powder, graphite and a solid particular lubricant having a vaporizing temperature less the sintering temperature, preferably less than about 800° C. and a maximum particle size less than about 0.3 of the maximum size of the iron based powder as measured by laser diffraction measurement.

8 Claims, No Drawings

IRON POWDER COMPOSITIONS

This is a Continuation of International Application No. PCT/SE99/01850, filed Oct. 14, 1999, that designates the United States of America and claims priority for Swedish Application No. 9803566-0, filed Oct. 16, 1998.

FIELD OF THE INVENTION

The present invention concerns iron based powder compositions for the preparation of compacted and sintered products having improved properties. More specifically the invention concerns the influence of the largest particles of the lubricant and the iron based powder used in the composition on the dynamic properties of the final products.

BACKGROUND OF THE INVENTION

Fatigue performance of sintered steels are influenced by several factors which are interacting. The density was early established as one of the most influential factors together with the microstructure and alloy element content but also homogeneity, pore size and pore shape are known to influence the dynamic properties. This makes fatigue performance one of the most complex properties of PM materials.

OBJECTS OF THE INVENTION

An object of the present invention is to improve the dynamic properties of sintered steels, specifically sintered steels having a density between 6.8 and 7.6 g/cm$^3$.

Another object of the invention is to eliminate the influence of the particle size of the lubricant on the dynamic properties, especially the fatigue strength of the sintered parts.

A third object is to provide a method of improving the fatigue strength by selecting the particle size of the lubricant in view of the particle size of the iron powder.

SUMMARY OF THE INVENTION

According to the invention it has now been found that, even if the amount of the very largest particles of a lubricant constitutes a negligible or almost negligible fraction of the lubricant particle size distribution as well as of the amount of the lubricant, this fraction has an unexpectedly large detrimental effect on the pore size and accordingly on the dynamic properties.

Similarly it has been found that the very largest particles of the iron powder, i.e. the maximum size of the iron powder has an unexpectedly large detrimental effect on the dynamic properties. Thus in order to get improved dynamic properties the maximum size of the lubricant particles as well as the maximum size of the iron powder should be reduced. For presently commercially used ferrous based press powders this means that the maximum particle size of the lubricant should be less than about 60 $\mu$m as measured by laser diffraction measurement.

In order to achieve the best dynamic properties for a given iron based powder (at a given density) a relationship between the maximum size of the particles of the lubricant and the maximum size of the particles of the iron based powder has also been established. The term "maximum size" as used in this context is defined in the formula below.

In accordance with the invention it has been found that the particle size of the lubricant in a composition including the lubricant and an iron based powder for powder metallurgical preparation of compacted and sintered products should be selected so that the largest pores of the compacted and sintered product prepared from this composition should be equal to or less than the largest pores obtained in a compacted and sintered product prepared from the same composition without the lubricant, which in practice means that the compaction is performed in a lubricated die.

Empirically we have found the following relationship between the largest lubricant particles and the largest iron powder particles in order to avoid the influence of the lubricant on the size of the largest pores.

$$Lub_{max} \leq 0.31 \times Fe_{max} - 26, \text{ wherein}$$

$Lub_{max}$ is the lubricant particle size in $\mu$m whereas 99.99% of the lubricant is finer.

$Fe_{max}$ is the iron particle size in $\mu$m whereas 99.99% of the iron powder is finer (this could also be expressed as $Lub_{max}$ is the size of the largest one hundredth of a percent fraction of lubricant particles in $\mu$m, $Fe_{max}$ is the size of the largest one hundredth of a percent fraction of the particles of the iron based composition in $\mu$m). This means that the maximum particle size of the lubricant as defined above should be less than about 0.3 of the maximum size of the iron or iron-based particles.

DETAILED DESCRIPTION OF THE INVENTION

The iron based powder according to the invention may be an alloyed iron based powder, such as a prealloyed iron powder or an iron powder having the alloying elements diffusion-bonded to the iron particles. The iron based powder may also be a mixture of an essentially pure iron powder and the alloying elements.

The alloying elements which can be used in the compositions according to the present invention may be one or more elements selected from the group consisting of Ni, Cu, Cr, Mo, Mn, P, Si, V and W. The particle sizes including the maximum particle sizes of the alloying elements are smaller than those of the iron or iron-based powder. The various amounts of the different alloying elements are between 0 and 10, preferably between 1 and 6% by weight of Ni, between 0 and 8, preferably between 1 and 5% by weight of Cu, between 0 and 25, preferably between 0 and 12% by weight of Cr, between 0 and 5, preferably between 0 and 4% by weight of Mo, between 0 and 1, preferably between 0 and 0.6% by weight of P, between 0 and 5, preferably between 0 and 2% by weight of Si, between 0 and 3, preferably between 0 and 1% by weight of V and between 0 and 10, preferably between 0 and 4% by weight of W.

The iron based powder may be an atomised powder, such as a wateratomised powder, or a sponge iron powder.

The particle size of the iron based powder is selected depending on the final use of the sintered product and, according to the present invention is has been found that also the maximum particle size of the iron based powder has an unexpectedly large detrimental effect on the dynamic properties of the sintered product.

The type of lubricant is not critical and the lubricant may be selected from a wide variety of solid lubricants. Specific examples of suitable lubricants are conventionally used lubricant such as Kenolube®, Metalub, (both available from Höganäs AB Sweden) H-Wachs® (available from Clariant), and zinc stearate (available from Megret). The amount of the lubricant may vary between 0.1 and 2, preferably between 0.2 and 1.2. Furthermore the vaporising temperature of the lubricant should be below the sintering temperature of the compacted part. Presently used lubricant which may be used according to the present invention have vaporising temperatures less than about 800° C.

The amount of graphite varies between 0 and 1.5, preferably between 0.2 and 1% by weight of the composition. Also, the maximum particle size of the graphite powder should be equal to or smaller than the maximum particle size of the lubricant.

In addition to the iron based powder, optional alloying elements, graphite and lubricant(s) the compositions according to the invention may also include optional conventionally additives, such as MnS, Mnx™.

The improved dynamic properties which can be obtained according to the present invention are especially interesting in sintered products having densities between 6.8 and 7.6 g/cm$^3$, especially between 7.0 and 7.4/cm$^3$.

Examples of preferred iron based powders plus preferred amounts of graphite follows below:

Iron+4% Ni+1.5% Cu+0.5% Mo where the alloying elements are diffusion bonded to the iron particle mixed with 0.4 to 1% graphite.

Iron+1.75% Ni+1.5% Cu+0.5% Mo where the alloying elements are diffusion bonded to the iron particle mixed with 0.4 to 1% graphite.

Iron+5% Ni+2% Cu+1% Mo where the alloying elements are diffusion bonded to the iron particle mixed with 0.4 to 1% graphite.

Iron prealloyed with 1.5% Mo and 2% Ni diffusion bonded to the iron/Mo particle which are mixed with 0.4 to 1% graphite.

Iron prealloyed with 1.5% Mo and 2% Cu diffusion bonded to the iron/Mo particle which are mixed with 0.4 to 1% graphite.

Iron prealloyed with 1.5% Mo and 2% Cu and 4% Ni diffusion bonded to the iron/Mo particle which are mixed with 0.4 to 1% graphite.

Iron prealloyed with 1.5 or 0.85% Mo and mixed with 0.4 to 1% graphite.

Iron prealloyed with 3% Cr and 0.5% Mo and mixed with 0.2 to 0.7% graphite.

These iron based powders all contains powders with a particle size below 212 μm sieved.

According to one especially preferred embodiment of the invention the maximum particle size of the iron based powder should be less than about 220 μm (which is obtained for e.g. Astaloy Mo −106 μm, through sieve analysis), and for this powder the maximum particle size of the lubricant should be less than 60 μm as measured by laser diffraction measurement.

The compacting and sintering steps for the preparation of the final products, which are distinguished by essentially the same or better dynamic properties as obtained for the same composition but without lubricant are performed under conventional conditions, i.e. the compaction is carried out at pressures between 400 and 1200 MPa and the sintering is performed at temperatures between 1100 and 1350° C.

The invention is further illustrated by the following non limiting examples.

EXAMPLE 1

Five mixes with the same nominal composition were prepared from Distaloy AE which is a pure iron powder which has 4% Ni, 1.5% Cu and 0.5% Mo diffusion annealed to it and which has a main particle size range between 20 and 180 μm. The mixes mainly consisted of Distaloy AE+0.3% C (UF-4)+0.8% Metalub®
Distaloy AE+0.3% C (UF-4)+0.8% zinc stearate
Distaloy AE+0.3% C (UF-4)+0.8% Hoechst wachs®
Distaloy AE+0.3% C (UF-4)+0.8% Kenolube®
Distaloy AE+0.3% C (UF-4) (reference, lubricated die)

The following maximum particles sizes of the lubricants were measured by the laser diffraction measurement technique:

| Type of lubricant | Maximum particle size, μm |
|---|---|
| Metalub ® | 147 |
| zinc stearate | 73 |
| Hoechst wachs ® | 51 |
| Kenolube ® | 73 |

From these mixes 5 TS bars were compacted to a density of 7.10 g/cm$^3$. For the mix without lubricant the tool surface was lubricated with zinc stearate dispersed in acetone. All bars were sintered at 1120° C. for 30 minutes in endothermic atmosphere with a carbon potential corresponding to 0.3% carbon content. After sintering the density, carbon content and pore size distribution were evaluated. Also the particle size distribution of the different lubricants was measured using a Sympatec Helos laser diffraction particle size analysing equipment. The lubricants were dispersed in air for the particle measurement.

The bars manufactured from the different mixes defined above had a very even carbon content and density after sintering. Metallografic samples were prepared and the pore size distribution was measured on a surface of 25 mm$^2$ for every material.

The relationship between the different lubricants are identical for the pore size distribution and the particle size distribution, which indicates that the size of the largest lubricant particles governs the size of the largest pores at least for the lubricants containing particles larger than approximately 60 μm. The pore size distribution for the lubricated die however shows that the reduction of the internal friction with addition of lubricants decreases the size of the intermediate porosity. In the case with the lubricant with the smallest coarse fraction/maximum particle size, lubricant C, the lubricant does not at all contribute to the amount of coarse pores. As can be seen from the above experiment lubricants with particles larger than 60 μm creates coarse pores in a component made of Distaloy AE+0.5% C at 7.1 g/cm$^3$. A decrease of the fraction of coarse pores will increase the dynamical properties.

These results demonstrate the possibility to produce a material with finer porosity at a given density by using a lubricant, the maximum particle size of which is determined in view of the maximum particle size of the iron based powder in accordance with the present invention.

EXAMPLE 2

The following example illustrates the effect on the fatigue strength of eliminating the largest particles of the lubricant as well as the largest particles of the iron based powder.

The following mixes were used

Astaloy Mo+0.3% C (UF-4)+0.8% of Hoechst Wachs
Astaloy Mo (−106 μm)+0.3% C (UF-4)+0.8% of Hoechst Wachs.

Astaloy Mo is a prealloyed material with 1.5% Mo (available from Höganäs AB, Sweden) which has an approximate particle size range distribution of 20–180 μm. The sieved finer grade powder Astaloy Mo −106 μm was used to demonstrate the effect of eliminating the largest particles of the iron based powder. The maximum particle size of Astaloy Mo as measured by laser diffraction measurement (Sympatec Helos laser) and the maximum particle size of Astaloy Mo −106 μm were 363 and 214 μm, respectively.

From all materials 20 fatigue test bars and 7 tensile strength bars were pressed to 7.1 g/cm$^3$ and sintered at 1120° C. for 30 minutes in endothermic atmosphere with a controlled carbon potential. The bars were then evaluated with respect to static properties and fatigue strength according to the staircase method described in Sonsino C. M. "Method to determine relevant material properties for the fatigue design of powder metallurgy parts", Powder Metallurgy International 1984 vol. 16 p. 34–36. The pore size distribution was evaluated according to the method described in Example 1.

The results obtained demonstrate that the products prepared from the finer base powder Astaloy Mo (−106 μm) and finer lubricant powder Hoechst Wachs have less large pores and an increase of the fatigue strength of about 15% is obtained with the decreasing fraction of coarse pores. For the tensile strength there is a small increase of approximately 5% with decreasing fraction of coarse pores.

What is claimed is:

1. A composition of an iron based powder, graphite and solid lubricant particles having a vaporizing temperature lower than a sintering temperature of the composition, and a maximum particle size less than about 0.3 of the maximum size of the iron based powder as measured by laser diffraction measurement, the maximum particle size being at most 60 μm.

2. The composition according to claim 1, wherein the maximum particle size of the graphite particles is equal to or less than the maximum size of the lubricant particles.

3. The composition according to claim 1 wherein the iron based powder has a maximum particle size less than 220 μm measured by laser diffraction measurement.

4. The composition according to claim 1, wherein the vaporizing temperature is less than 800° C.

5. The composition according to claim 1, wherein the iron based powder includes, in weight %, up to 10% Ni, up to 8% Cu, up to 25% Cr; up to 5% Mo, up to 1% P, up to 5% Si, up to 3% V, and up to 4% W.

6. The composition according to claim 1, wherein the composition includes, in weight %, 0.1 to 2% of the lubricant.

7. The composition according to claim 1, wherein the composition includes, in weight %, 0.2 to 1.2% of the lubricant.

8. The composition according to claim 1, wherein the composition includes, in weight %, 0.2 to 1% of the graphite.

* * * * *